US006644977B1

(12) United States Patent
Dollhofer

(10) Patent No.: US 6,644,977 B1
(45) Date of Patent: Nov. 11, 2003

(54) ASSEMBLY FOR TRANSMITTING ELECTRICAL SIGNALS AND/OR ENERGY

(75) Inventor: Kurt Dollhofer, Kaufbeuren (DE)

(73) Assignee: Schlefring und Apparatebau GmbH (DE)

( * ) Notice: Subject to any disclaimer, the term of this patent is extended or adjusted under 35 U.S.C. 154(b) by 0 days.

(21) Appl. No.: 09/555,567

(22) PCT Filed: Dec. 31, 1998

(86) PCT No.: PCT/DE98/03815

§ 371 (c)(1),
(2), (4) Date: Aug. 22, 2000

(87) PCT Pub. No.: WO99/35720

PCT Pub. Date: Jul. 15, 1999

(30) Foreign Application Priority Data

Dec. 31, 1997 (DE) ..... 197 58 261

(51) Int. Cl.[7] ..... H01R 39/00
(52) U.S. Cl. ..... 439/13; 439/886; 439/887
(58) Field of Search ..... 439/886, 887, 439/931, 13; 200/267, 263, 264, 252, 253, 268

(56) References Cited

U.S. PATENT DOCUMENTS 2,298,236 A * 10/1942 Siegmund ..... 439/714
2,501,164 A * 3/1950 Durst ..... 29/879
5,139,891 A * 8/1992 Cowie et al. ..... 428/670
5,281,176 A * 1/1994 Yahagi et al. ..... 439/887
5,316,507 A * 5/1994 Capp ..... 439/886
5,634,800 A * 6/1997 Giamati ..... 439/22
5,876,862 A * 3/1999 Shibuya et al. ..... 428/672

* cited by examiner

*Primary Examiner*—Renee Luebke
*Assistant Examiner*—Ann McCamey
(74) *Attorney, Agent, or Firm*—St. Onge Steward Johnston & Reens LLC

(57) ABSTRACT

An arrangement for transmitting electrical signals and/or energy between units mobile relative to each other, by means of galvanic contacts and a sliding-contact arrangement in particular. The inventive device excels itself by the provisions that at least one of said contacts comprises a basic material having a high mechanical stability, into which a second material is embedded which presents good electrical characteristics with respect to the transmission of electrical signals and/or energy, and that said second material is so distributed in said basic material that at least one further contact, which contacts this contact, is in contact with said second material along the major part of the trajectory of the movement.

20 Claims, 3 Drawing Sheets

ASSEMBLY FOR TRANSMITTING ELECTRICAL SIGNALS AND/OR ENERGY

FIELD OF THE INVENTION

The present invention relates to an arrangement for transmitting electrical signals and/or energy between units mobile relative to each other, by means of a sliding contact arrangement.

PRIOR ART

For the transmission of electrical signals between units mobile relative to each other, sliding contacts are preferably employed. For linear movement, these contacts are also known by the term slideways, whereas for circular movement they are known as slip rings.

Such mechanical contact systems excel in simplicity and high sturdiness. For different applications, different contact pairings are available, which are selected based upon environmental conditions, contacting rate, and the electrical signals. When in the case of high contacting rates or high rotational speeds in the case of slip rings, a long service life is required and contact pairings are employed almost exclusively where at least one contact contains a combination of silver and graphite. In this combination, the silver is utilized to produce good electrical contact while the graphite serves lubricating purposes.

As has been demonstrated in tests, an excellent signal quality can be achieved with such a silver-graphite brush on an all-silver slideway. Transition resistance and even contact noise are particularly stable and low over long service periods. However, the high cost of this arrangement is a disadvantage. These disadvantages are felt particularly when large-size slip rings or slideway arrangements are used, because in these cases the slideways must be made of solid silver. When, because of excessive cost, a less expensive contact material such as brass or copper is utilized, these less expensive materials have a detrimental effect on the electrical transmission characteristics of the system. The transition resistance and contact noise may both be higher compared with the silver array, by up to two orders.

A known method of solving this problem is the application of solid brass slideways which are provided with a silver contact surface. Silver plating can here be made by a mechanical deposition of a silver coating or even by electrochemical treatment. The disadvantage of such an arrangement resides in the comparatively thin deposited silver layer. In case of high loads this layer can be worn off after a short time already and the brass slideway then remaining presents again very insufficient transmission characteristics.

The transmission characteristics of such sliding contacts are usually characterised by a number of electrical parameters. When high currents are transmitted the transition resistance is of particular importance. This parameter should be very low, preferably within the range of a few mΩ. Towards lower signal levels, which occur, for instance, in measuring and sensor signals, the contact noise is important as well. Such noise occurs during the movement of the contacts as a result of mechanical vibration, a change of the contact point and additionally on account of small electric arcs which may be formed between the two contact electrodes. Low contact noise is particularly important for a good signal quality.

BRIEF DESCRIPTION OF THE INVENTION

The present invention is based on the problem of providing an arrangement for transmitting electrical signals and/or energy between units mobile relative to each other, by means of galvanic contacts and particularly a sliding contact arrangement, which will, on the one hand, offer a long service life and a high degree of reliability, even at high contacting rates, and, on the other hand, ensure an excellent quality in signal transmission.

One inventive solution to this problem is defined in Patent Claim 1. Improvements of the invention are the subject matters of the dependent Claims.

In accordance with the invention, at least one of the contacts presents a basic material having a high mechanical stability and into which, a second material that posses good electrical properties for the transmission of electrical signals and/or energy, is embedded. The second material is distributed in the basic material, so that at least one further contact that contacts the first contact, is in contact with the second material along the trajectory of its movement.

The invention hence combines the advantages of two different contact materials such as steel, brass or copper and silver. Here, the basic material, which is resistant to wear and inexpensive, serves as carrier of the arrangement whilst the second material, which presents good electrical properties, serves as contacting material. Due to this inventive configuration a particularly high transition quality can be achieved.

The contact consisting of a basic material, with a second material embedded therein, may be a slideway of a slip ring or contact brush, for instance.

The second material may be dispersed in the surface of the basic material, alternatively or additionally, the basic material may have at least one recess in which the second material is embedded. This recess may be a dovetailed groove, in particular, and with such a positive locking a particularly good connection is achieved between the two materials.

It is moreover expedient that the recess extends obliquely with respect to the sliding direction, in particular with an undulated course, at least in sections.

According to an alternative, the second material may be embedded in the form of several islets, i.e. contact areas externally separated from each other, or in the form of a trajectory in the basic material.

In any case it is advantageous, however, to vary the recess in terms of its extension or its shape orthogonally to the sliding direction in such a way that as a result of the contact with the sliding contact connection traces of the second material are rubbed into the basic material. On account of the sliding motion of the contacts minute particles of the second material having the good electrical properties are rubbed into the surface of the basic material, i.e. the solid contact trajectory, where they remain embedded in the surface as a properly conductive coating. As a result, the conductivity and particularly the contact noise as well as the transition resistance of the entire arrangement are substantially improved.

In yet another embodiment of the present invention, the second material is selected so that it is softer than the basic material. It can thus be easily transferred into the surface of the basic material.

It is moreover preferred to support at least one contact element element with a certain tolerance in a direction orthagonal on the main sliding direction. Owing to the small additional movements of the bursh transversely or obliquely to the main axis of movement, the second contact material can be better distributed over the contact trajectory consisting of the basic material. This may be achieved in a particularly simple manner by means of a suspension or support with high tolerances permitting a better bearing clearance. This can, of course, also be achieved by a selective control of the movement with guidance of the contacts so as to cause them to follow a predetermined trajectory.

In another expedient embodiment of the invention the trajectory of the second material is configured in a shape varying from the shape of the main trajectory of the arrangement. This may be a helical trajectory, for instance.

In the contact arrangement described above, which consists of a brush containing preferably an electrically conductive material and a lubricating material, where a contact trajectory comprises an electrically conductive material. It is therefore irrelevant whether these components are exchanged, i.e. a brush having an electrically conductive material on a contact trajectory comprising a combination of an electrically conductive material and a lubricating material such as silver and graphite. In such a case, the inventive arrangement would apply for the brush, which now contains two different conductive materials.

BRIEF DESCRIPTION OF THE DRAWINGS

The invention will be described in more details in the following by an exemplary embodiment, with reference to the drawing wherein.

DESCRIPTION OF AN EMBODIMENT

Figure 1:
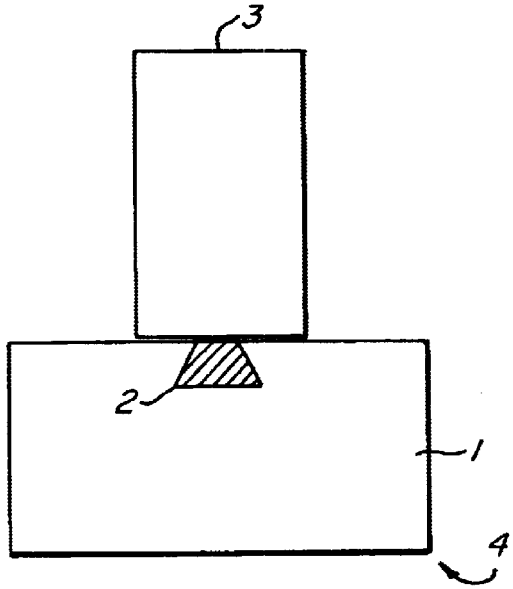
FIG. 1 shows an inventive arrangement.

FIG. 1 shows an inventive arrangement consisting of a first contact partner which, in its turn, includes a basic material or a first material (1) having good mechanical properties, as well as a slight quantity of a second material (2) having appropriate electrical characteristics.

For a better mechanical fixing, the second material is provided in a groove designed in a dovetailed shape. Moreover, a second contact partner (3) is included which may be a brush, for instance, consisting of silver and graphite. It is irrelevant, of course, whether in this arrangement the brush consists of silver and graphite or whether the trajectory as such consists of such a material or whether a brush is realised with the two aforedescribed contact partners.

Figure 2:
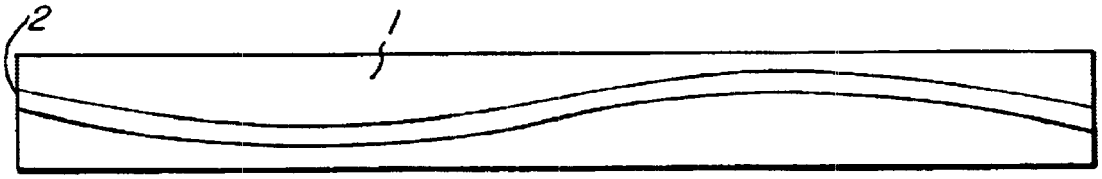
FIG. 2 illustrates an arrangement including a trajectory of the second contact, which is laid in an undulated configuration.

FIG. 2 illustrates an arrangement consisting of a first contact material (1) as well as a trajectory of a second contact material (2) which is laid in an undulated configuration therein so that a better distribution of these contact material is achieved throughout the entire surface, particularly of the first material (1).

Figure 3:
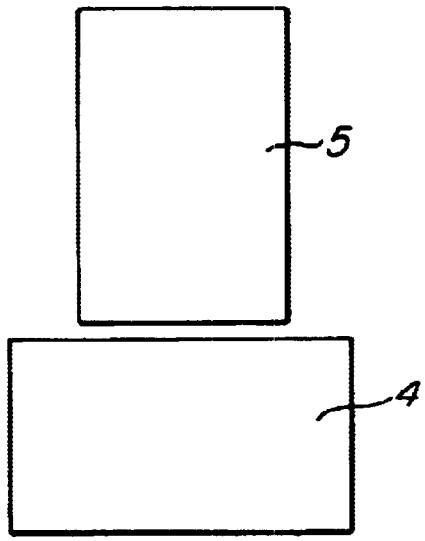
FIG. 3 illustrates the inventive arrangement according to FIG. 1.

FIG. 3 illustrates another advantageous embodiment of the present invention. A slideway 4 is positioned relative to contact brush 5 such that contact brush 5 contacts slideway 4.

Figure 4:
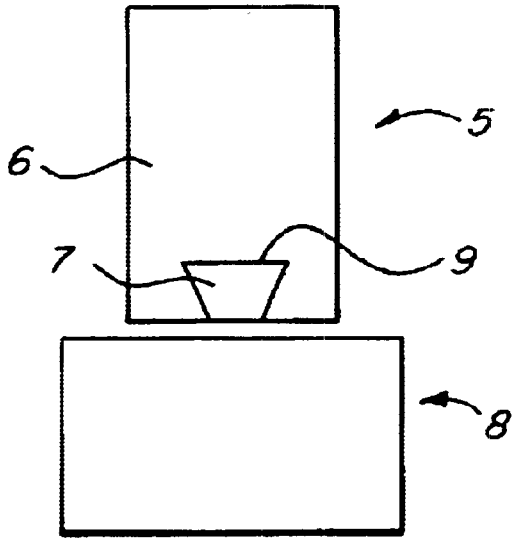
FIG. 4 illustrates another inventive arrangement of the present invention.

FIG. 4 illustrates yet another advantageous embodiment of the present invention. A slip ring 8 is coupled with a contact brush 5. The contact brush 5 comprises a first material 6 having high mechanical hardness and a second material 7 which is electrically conductive. The second material 7 is deposited in a dovetail shaped groove 9 in the first material 6. The dovetail shaped groove 9 may comprise an undulated course transversely to the trajectory of movement as depicted in FIG. 2.

Figure 5:
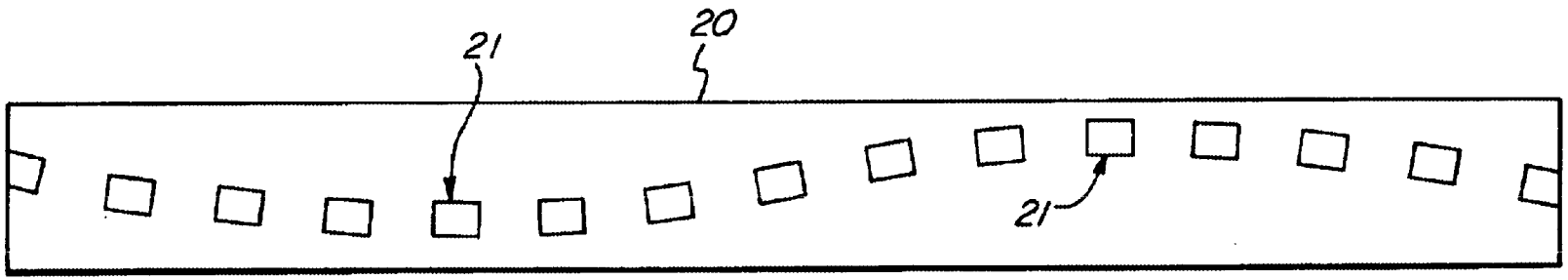
FIG. 5 shows still another inventive arrangement of the present invention.

FIG. 5 shows an arrangement comprising a first contact material (20) and a trajectory of a second contact material (21). The second contact material (21) is formed as several islets that have an undulated configuration therein so that a better distribution of the contact material is achieved throughout the surface of the first material (20).

What is claimed is:

1. A system for transmitting electrical signals and/or energy between units mobile relative to each other through a sliding contact arrangement, the system comprising:

a slideway comprising a first material, said slideway having a recess formed along a trajectory of movement and an insert having a width (I) and located in the recess; and a contact, which touches the slideway along a the trajectory of movement, said contact having a width (L);

wherein said contact width (L) is greater than said insert width (I) such that said contact touches both said first and said second material as it move along the trajectory of movement and said second material electrically contacts said first material.

2. The system according to claim 1, wherein said second material has a lower electrical resistance than the first material and the first material has a higher mechanical hardness than the second material.

3. The system according to claim 1, wherein said slideway is a component of a slip ring assembly.

4. The system according to claim 1, wherein said second material is dispersed in the surface of said first material.

5. The system according to claim 1, wherein said recess is a dovetail-shaped groove.

6. The system according to claim 1, wherein said second material is arranged in the form of a trajectory along said trajectory of movement.

7. The system according to claim 1, wherein said recess varies in its extension or in its shape in a direction orthogonal to the trajectory of movement in such a way that, by the contact of the slideway connection, traces of said second material are deposited into said first material.

8. The system according to claim 1, wherein said sliding contact arrangement is configured so that the relative movement of the slideway and the contact takes place along a varying or non-symmetrical trajectory.

9. The system according to claim 1, wherein at least one further contact region is provided which consists of graphite and which lubricates said sliding-contact connection in sliding motion.

10. The system according to claim 1, wherein the recess extends obliquely relative to the sliding direction, at least in sections.

11. The system according to claim 10, wherein said recess had an undulated course.

12. The system according to claim 1, wherein at least one contact element is supported with a tolerance in a direction orthogonal on a main sliding direction.

13. The system according to claim 12, wherein said contact element is guided orthogonally on or obliquely relative to the main sliding direction when said sliding-contact connection is sliding.

14. The system according to claim 1, wherein said second material is selected so that it is softer than said first material.

15. The system according to claim 14, wherein said first material is steel, copper, a copper or a brass alloy, and that said second material is silver or a silver alloy.

16. The system according to claim 1, wherein said second material is embedded into said first material in the form of several islets.

17. The system according to claim 16, wherein said several islets comprise contact areas externally separated from each other.

18. A system for transmitting electrical signals and/or energy between units mobile relative to each other through a sliding contact arrangement, the system comprising:

a slideway comprising a first material, said first material having a recess formed along a trajectory of movement;

an insert formed of a second material deposited in said recess, said insert having a width (I), where said second material has a lower electrical resistance than the first material and the first material has a higher mechanical hardness than the second material and wherein said second material electrically contacts said first material;

a contact having a width (L);

wherein said contact width (L) is greater than said insert width (I) such that the contact, which contacts the slideway along said trajectory of movement, touches said first and said second material along said trajectory of movement.

19. A system for transmitting electrical signals and/or energy between units mobile relative to each other through a sliding contact arrangement, the system comprising:

a slideway; and a contact having a width (L) and comprising a first material, which contacts the slideway along a trajectory of movement, and a recess having a width (I) formed along the trajectory of movement, the recess having an insert located therein and comprising a second material;

wherein said contact width (L) is greater than said insert width (I) such that said contact touches both said first and said second material as it moves along the trajectory of movement and said second material electrically contacts said first material.

20. A system for transmitting electrical signals and/or energy between units mobile relative to each other through a sliding contact arrangement, the system comprising:

a slip-ring comprising a first material and having a recess formed therein along a trajectory of movement;

an insert comprising a second material and located in the recess, said insert having a width (I) that is transverse to the trajectory of movement, and said insert comprises a second material that electrically contacts the first material; and a contact which contacts said slip-ring along the trajectory of movement, said contact having a width (L) transverse to the trajectory of movement;

wherein said contact width (L) is greater than said insert width (I) such that said contact touches both said first and said second material as it moves along the trajectory of movement.

* * * * *